US007364164B2

(12) United States Patent
Anasis et al.

(10) Patent No.: US 7,364,164 B2
(45) Date of Patent: Apr. 29, 2008

(54) RECONFIGURABLE GOLF GAME

(76) Inventors: George Anasis, 3238 Woodstone Dr., Lewis Center, OH (US) 43035; Jay Scott Danner, 1511 Southcourt Dr., Indianapolis, IN (US) 46227

( * ) Notice: Subject to any disclaimer, the term of this patent is extended or adjusted under 35 U.S.C. 154(b) by 4 days.

(21) Appl. No.: 11/411,516

(22) Filed: Apr. 26, 2006

(65) Prior Publication Data

US 2007/0252325 A1 Nov. 1, 2007

(51) Int. Cl.
*A63F 7/06* (2006.01)

(52) U.S. Cl. ..... 273/317.2; 273/108.22; 273/129 R; 273/129 W

(58) Field of Classification Search ..... 273/108.31, 273/108.32, 108.22, 317.2, 129 R, 129 V, 273/129 W; 446/333–336; 473/282; D21/635, D21/579, 585, 576, 358
See application file for complete search history.

(56) References Cited

U.S. PATENT DOCUMENTS

| | | | | | |
|---|---|---|---|---|---|
| 731,825 | A * | 6/1903 | Voorhees | 273/108.22 |
| 750,134 | A * | 1/1904 | Vaile | 273/108.22 |
| 1,136,465 | A * | 4/1915 | Clark | 273/108.22 |
| 1,409,612 | A * | 3/1922 | Stout | 273/108.22 |
| 1,552,536 | A * | 9/1925 | Blevins et al. | 273/108.22 |
| 1,657,388 | A * | 1/1928 | Gorman | 273/108.22 |
| 1,739,467 | A * | 12/1929 | Klutho | 273/317.2 |
| 1,739,468 | A * | 12/1929 | Klutho | 273/317.2 |
| 1,803,134 | A * | 4/1931 | Renn | 273/108.22 |
| 1,926,980 | A * | 9/1933 | Gorman | 273/108.22 |
| 2,463,197 | A * | 3/1949 | Paupa | 273/317.2 |
| 2,513,198 | A * | 6/1950 | Munro | 273/108.22 |
| 2,616,700 | A * | 11/1952 | Munro | 273/108.22 |
| 2,638,348 | A * | 5/1953 | Arenson et al. | 273/108.22 |
| 2,960,796 | A * | 11/1960 | Woodrey | 446/358 |
| 3,179,413 | A * | 4/1965 | Lecierc | 273/108.22 |
| 3,190,653 | A * | 6/1965 | Karthaus | 273/108.22 |
| 4,239,217 | A * | 12/1980 | Thieme et al. | 273/108.22 |
| 4,279,419 | A * | 7/1981 | Barnes et al. | 273/108.22 |
| 4,322,081 | A * | 3/1982 | Terry et al. | 273/317.2 |
| 4,511,142 | A * | 4/1985 | Pote, Jr. | 273/317.2 |
| 5,449,171 | A * | 9/1995 | Makhoulian | 273/108.22 |
| 2002/0082107 | A1* | 6/2002 | Imahata | 473/282 |
| 2006/0082054 | A1* | 4/2006 | Johannson | 273/108.21 |

OTHER PUBLICATIONS

Arnold Palmer Enterprises, Arnold Palmer Indoor Golf Game, website—http://stores.musictoday.com/store/product.asp?band_id=1144&dept_id=8231&pf_id=6AAM15&sfid=19.
Arnold Palmer Indoor Golf Game, Rules & Instructions for Using the Game.

* cited by examiner

*Primary Examiner*—Sebastiano Passaniti

(57) ABSTRACT

A reconfigurable golf game having an interchangeable body, a hollow shaft, a swing actuation system, and a coupler. The coupler allows a user that purchases one game system including multiple interchangeable bodies to easily attach different interchangeable bodies to the hollow shaft thereby changing the game. The various interchangeable bodies mimic the look and swing characteristics of modem professional golfers. The swing actuation system includes a translational motion system, including a rack and prime mover, and a rotational motion system, including a pinion. In operation the user grips the hollow shaft and activates the translation motion system by pulling the prime mover, and thus the rack, away from the interchangeable body, the rotational motion system pinion cooperates with the rack thereby causing the rotating body portion to rotate from a maximum backswing position to a maximum follow-through position, striking the replica golf ball.

25 Claims, 19 Drawing Sheets

RECONFIGURABLE GOLF GAME

TECHNICAL FIELD

The instant invention relates to the field of golf games and toys; particularly, to a reconfigurable golf game having interchangeable bodies to mimic the likeness of well-known golfers.

BACKGROUND OF THE INVENTION

The popularity of the game of golf, and golf related games, has increased dramatically in the past two decades. This is illustrated by the fact that golf video games are among the most popular. Additionally, golf games that incorporate features and attributes more similar to the actual game of golf are becoming increasingly popular. One such game, known as the Arnold Palmer Indoor Golf Game (APIGG) has been around for years. The APIGG incorporates a putter length shaft having a permanent replica of the famous golfer Arnold Palmer attached at the end.

The APIGG device incorporates a grip at one end of the shaft for the player to hold in their hands. The APIGG device includes a finger trigger device conveniently positioned so that the index finger of a user easily fits into the trigger while the user grips the device as if they are gripping a conventional putter. The trigger is connected to a rod located inside the shaft so that as the user pulls the trigger toward the grip end of the shaft, or pushes the trigger toward the replica, the rod slides up and down inside the shaft. The end of the rod is connected to a linear gear that meshes with a rotary gear located within the player replica. The rotary gear rotates the shoulders and arms of the replica player to simulate an actual golf swing. The present swing of the APIGG device is generic and not representative of Arnold Palmer, the player that the replica is supposed to resemble.

While the APIGG device has been incredibly successful, it does have some weaknesses. Firstly, users of the game are often playing a 9-hole or 18-hole match with up to four users utilizing the same APIGG device. Generally all four players don't want to be the same Arnold Palmer replica. This is akin to playing the game of Monopoly with all players being represented by the thimble. Therefore, there has been a need for a device that allows the users to easily change the replica players during the contest so that each user may be represented by a different player.

Secondly, the APIGG device has a generic swing that does not mimic the swing of the player being represented. A need exists for a method of easily customizing the swing characteristics of a particular replica, namely the length of the backswing and follow-through, to mimic the actual swing of the player being represented, while still allowing for economical mass production of the components. Thirdly, users of the current APIGG device must always have extra golf balls in their pockets and repeatedly bend down to properly position a new ball in front of the club of the golfer replica. Therefore, the need exists for a ball storage and distribution system that discharges a ball close to the golfer replica as needed.

Fourthly, the rigid body of the APIGG player makes it difficult to achieve the proper player replica stance as clubs of longer or shorter length are used. For instance, when the replica golfer is fitted with the longest club, the driver, the player must reduce the angle between the shaft and the ground to accommodate for the longer club and achieve a swing that sweeps across the location of the ball. As a result of reducing this angle the toes of the replica golfer are up in the air, thus not flush with the ground. Conversely, when short clubs such as a wedge or putter are used, the heels of the replica golfer are up in the air to properly strike the ball with the club. The present invention solves the weaknesses of the APIGG.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

The present invention is a reconfigurable golf game having an interchangeable body, a hollow shaft, a swing actuation system partially housed in the interchangeable body and the hollow shaft, and a coupler releasably joining the interchangeable body and the hollow shaft. The interchangeable body has a non-rotating body portion and a rotating body portion. The rotating body portion is rotably attached to the non-rotating body portion and includes a club receiver for releasably retaining a club. The hollow shaft has a shaft proximal end, a shaft distal end, an interior surface, an exterior surface, and an actuation system slot.

The swing actuation system includes a translational motion system and a rotational motion system. The translational motion system includes a prime mover and a rack, wherein the prime mover is slidably disposed within the hollow shaft. The rack is designed to cooperate with a pinion of the rotational motion system. The rotational motion system is attached to the rotating body portion and includes a pinion that cooperates with the rack. In operation, the user grips the hollow shaft and activates the translation motion system by pulling the prime mover. The movement of the prime mover away from the interchangeable body results in movement of the rack. Since the rack cooperates with the pinion, the movement of the rack causes the rotating body portion to rotate from a maximum backswing position to a maximum follow-through position, striking the replica golf ball in the process.

The last main component is the coupler that releasably connects the interchangeable body mounting device to the shaft. The coupler allows a user that purchases one game system including multiple interchangeable bodies to easily attach different interchangeable bodies to the hollow shaft thereby changing the game. The various interchangeable bodies may mimic the look and swing characteristics of modern professional golfers.

These variations, modifications, alternatives, and alterations of the various preferred embodiments may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

DETAILED DESCRIPTION OF THE INVENTION

The reconfigurable golf game (10) of the instant invention enables a significant advance in the state of the art. The preferred embodiments of the device accomplish this by new and novel arrangements of elements and methods that are configured in unique and novel ways and which demonstrate previously unavailable but preferred and desirable capabilities. The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
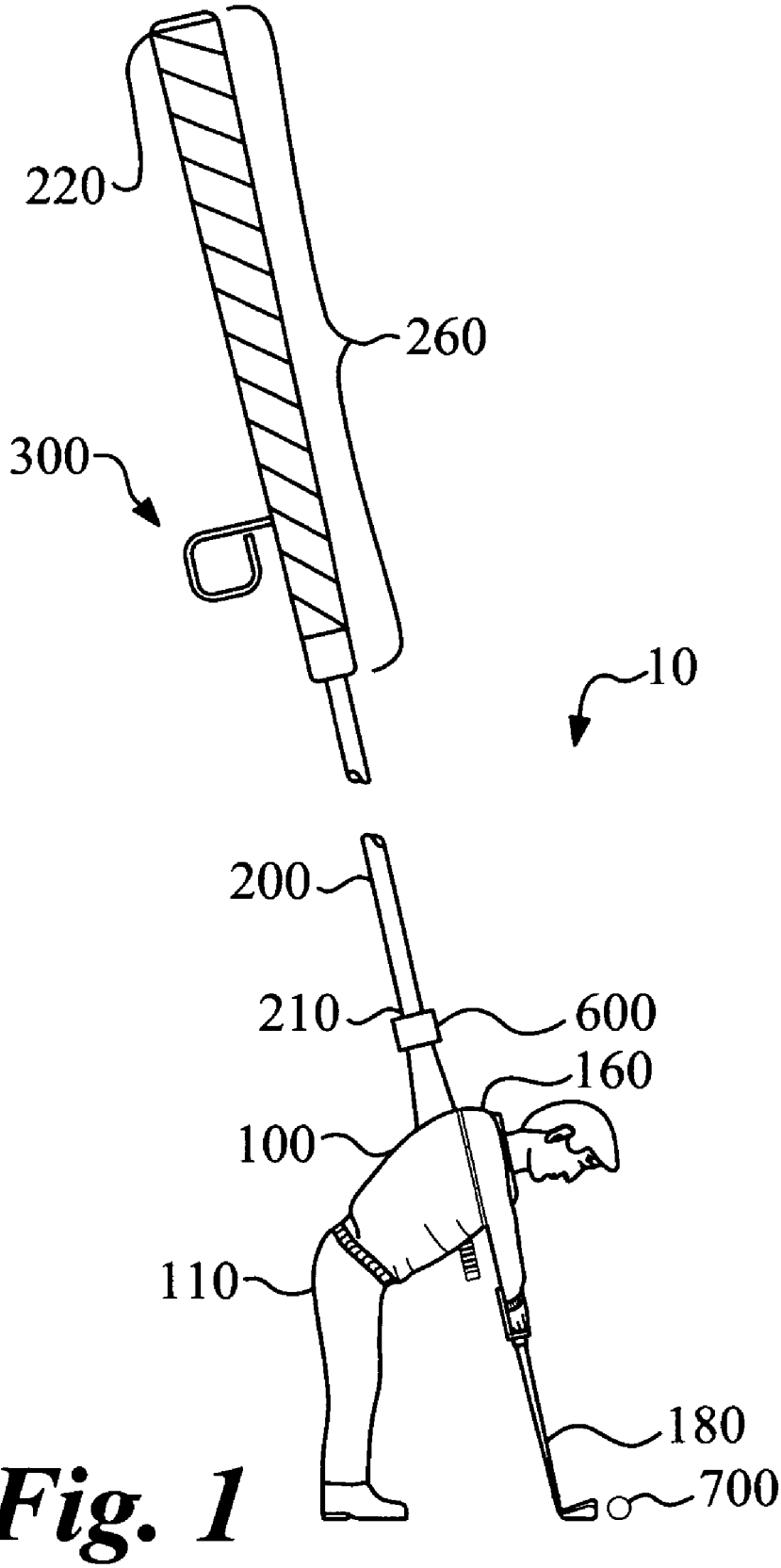
FIG. 1 is a side elevation view of the reconfigurable golf game of the present invention, not to scale.

The present invention is a reconfigurable golf game (10), as seen in FIG. 1. The reconfigurable golf game (10) includes an interchangeable body (100), a hollow shaft (200), a swing actuation system (300) partially housed in the interchangeable body (100) and the hollow shaft (200), and a coupler (600) releasably joining the interchangeable body (100) and the hollow shaft (200).

Figure 2:
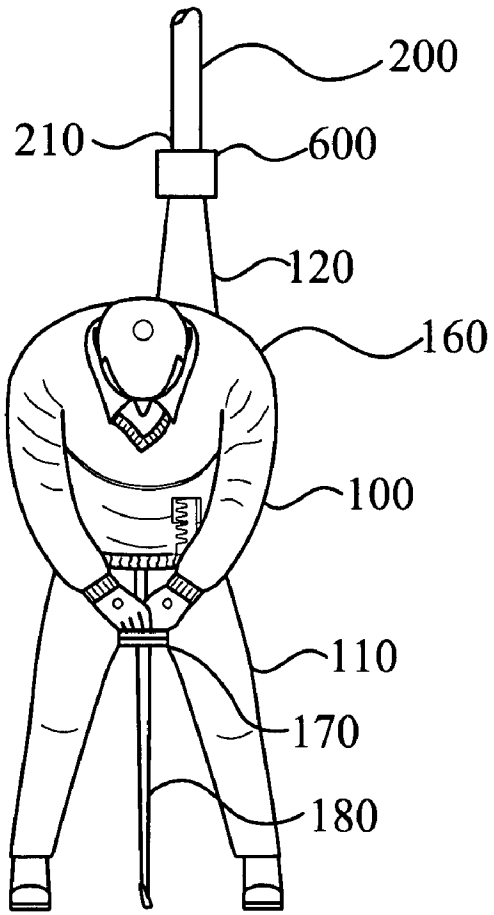
FIG. 2 is a partial front elevation of the reconfigurable golf game of the present invention, not to scale.
Figure 15:
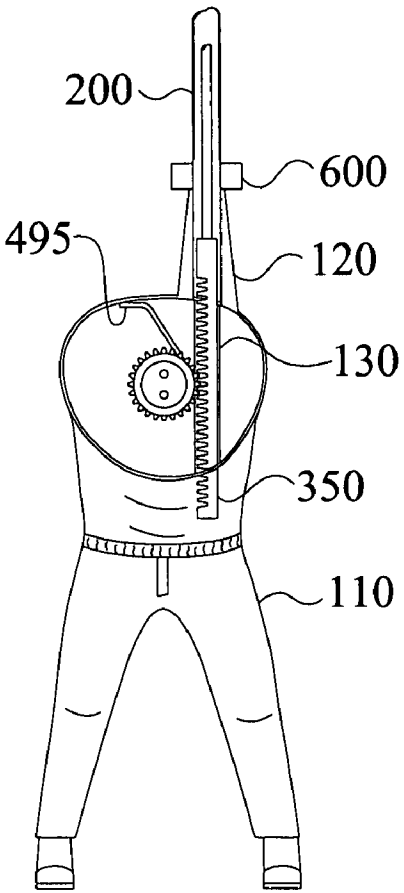
FIG. 15 is a partial cross-sectional view taken along section line 15-15 of FIG. 14, not to scale.
Figure 14:
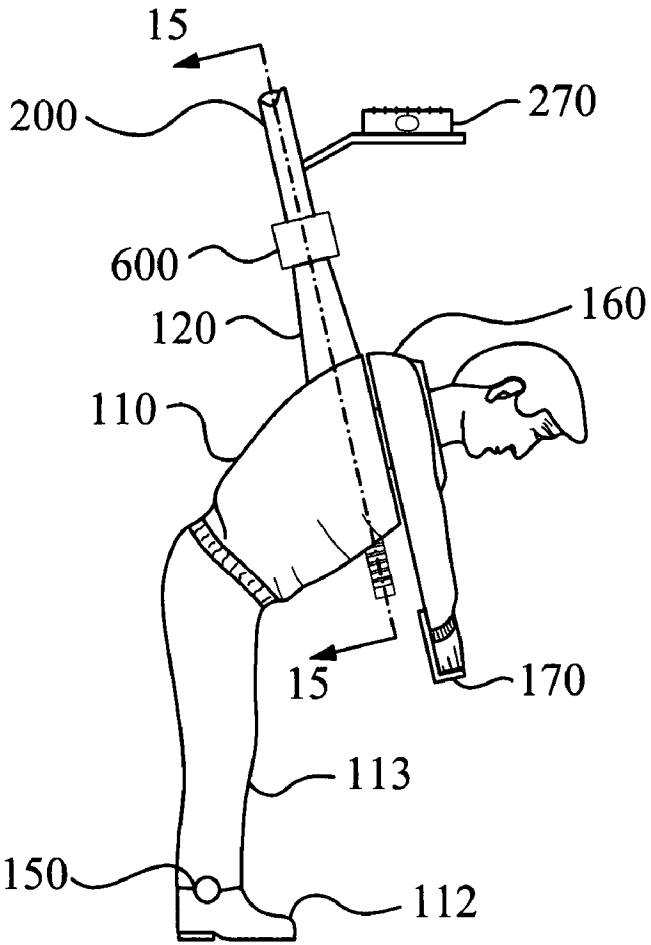
FIG. 14 is a partial side elevation of the reconfigurable golf game of the present invention, not to scale.

The interchangeable body (100) has a non-rotating body portion (110) and a rotating body portion (160), seen best in FIGS. 2 through 7. The non-rotating body portion (110) includes a mounting device (120) and is formed with a rack passageway (130), as seen in FIG. 15. The rotating body portion (160) is rotably attached to the non-rotating body portion (110) and includes a club receiver (170) for releasably retaining a club (180), as seen in FIGS. 1 and 2.

Figure 22:
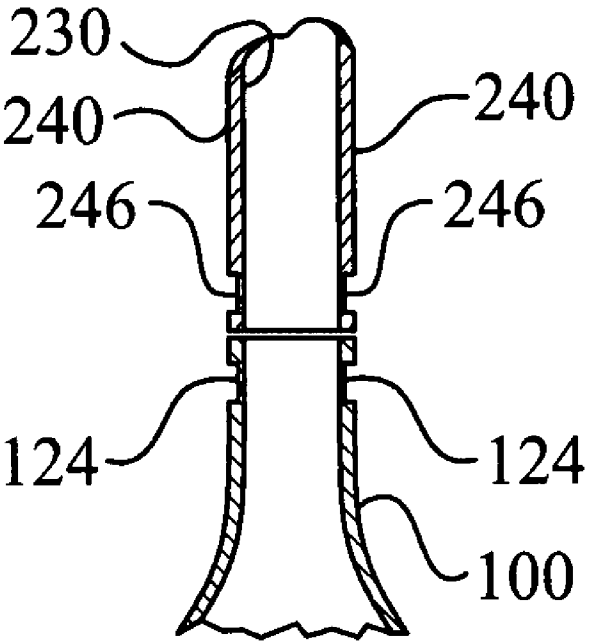
FIG. 22 is a partial cross-sectional view of a portion of the hollow shaft and a potion of the interchangeable body, not to scale.
Figure 26:
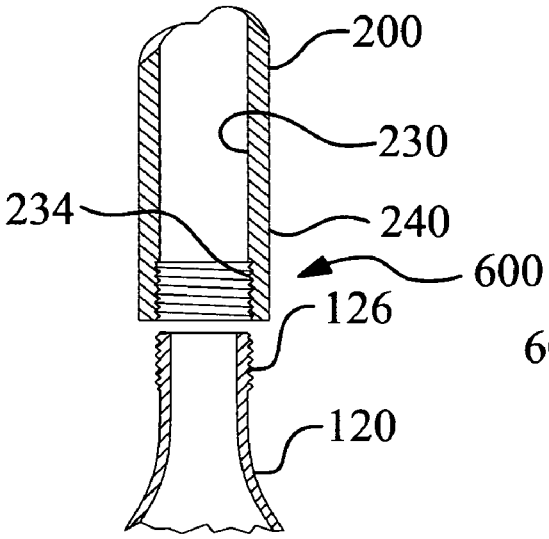
FIG. 26 is a partial cross-sectional view of a portion of the hollow shaft and a potion of the interchangeable body, not to scale.

The hollow shaft (200) has a shaft proximal end (210) and a shaft distal end (220), as seen in FIG. 1, as well as an interior surface (230) and an exterior surface (240), as seen in FIGS. 22 and 26. Additionally, the hollow shaft (200) is formed with an actuation system slot (250) extending from the interior surface (230) to the exterior surface (240), as seen in FIG. 8.

Figure 8:
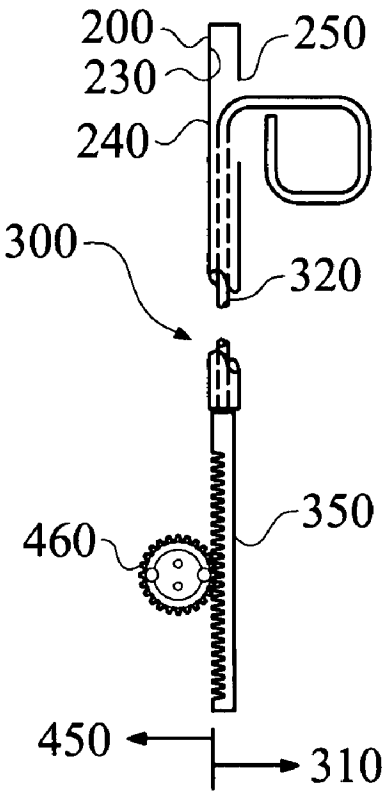
FIG. 8 is a partial front elevation view of the swing actuation system, not to scale.
Figure 9:
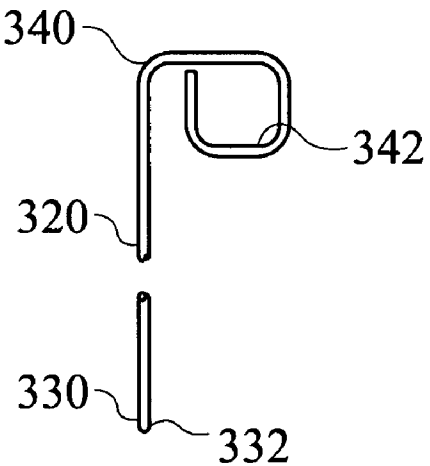
FIG. 9 is a partial front elevation view of the prime mover, not to scale.
Figure 10:
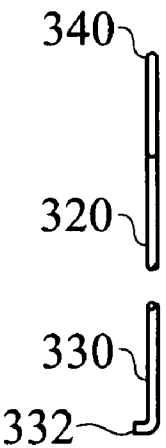
FIG. 10 is a partial side elevation view of the prime mover, not to scale.

The swing actuation system (300) includes a translational motion system (310) and a rotational motion system (450), as seen in FIG. 8. The translational motion system (310) includes a prime mover (320) and a rack (350). The prime mover (320) is slidably disposed within the hollow shaft (200). Further, the prime mover (320) has a mover proximal end (330) and a mover distal end (340), wherein the mover proximal end (330) has a mover engager (332) and the mover distal end (340) has a finger receiver (342), as seen in FIGS. 9 and 10. The finger receiver (342) is configured to extend through the actuation system slot (250) and is shaped to receive an index finger of a human hand.

Figure 12:
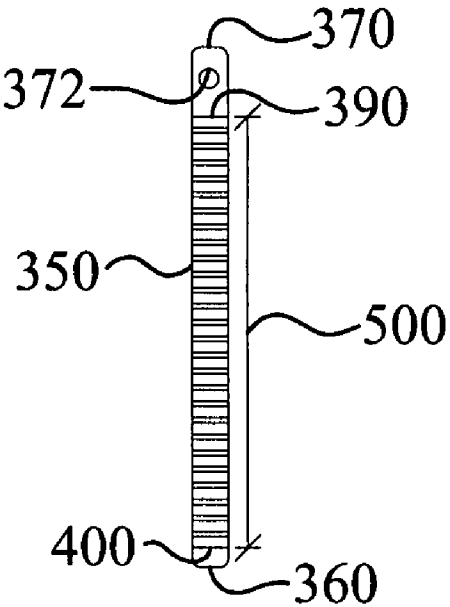
FIG. 12 is a front elevation view of the rack, not to scale.
Figure 11:
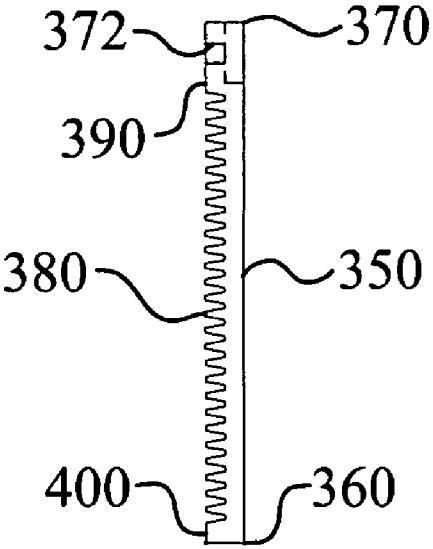
FIG. 11 is a side elevation view of the rack, not to scale.
Figure 16:
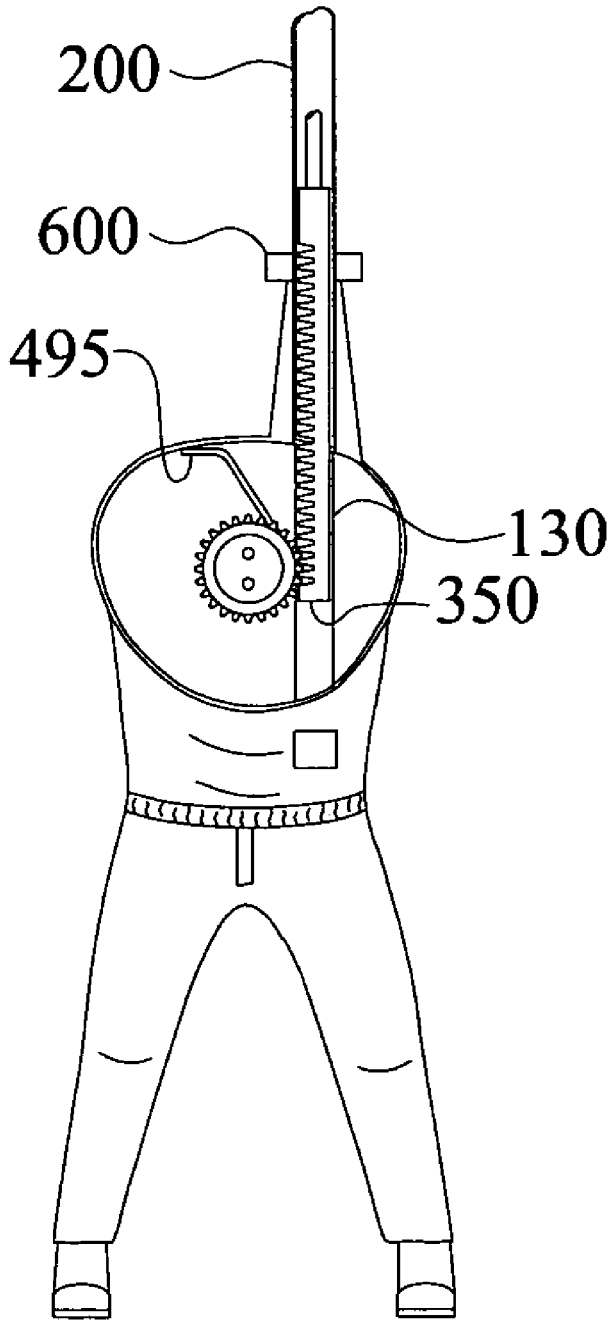
FIG. 16 is a partial cross-sectional view taken along section line 15-15 of FIG. 14, in a different position, not to scale.

The second element of the translational motion system (310) is the rack (350), seen in FIGS. 8, 11, and 12. The rack (350) is designed to cooperate with a pinion (460) of the rotational motion system (450). As seen in FIGS. 15 and 16, the rack (350) is located in part in the rack passageway (130), sometimes in part in the coupler (600), and may be in part located in the hollow shaft (200), depending on the embodiment and the rotational position. With reference now to FIGS. 11 and 12, the rack (350) has a rack proximal end (360), a rack distal end (370), and a plurality of rack teeth (380) located between the rack proximal end (360) and the rack distal end (370). Further, the rack distal end (370) has a receiver (372) designed to releasably cooperate with the mover engager (332) to transmit linear motion from the prime mover (320) to the rack (350), seen best in FIGS. 8 and 10. Additionally, the rack (350) has a maximum fixed backswing stop (390) located toward the rack distal end (370) and a maximum fixed follow-through stop (400) located toward the rack proximal end (360). The plurality of rack teeth (380) extend from the maximum fixed backswing stop (390) to the maximum fixed follow-through stop (400) defining a linear range of motion (500), seen in FIG. 12.

In the embodiment of FIGS. 10 and 11, the mover engager (332) is shaped as a hook, or tine, that cooperates with the rack receiver (372) formed as a recess of cooperating size and shape. Conversely, one with skill in the art will recognize that the rack receiver (372) may be shaped as a hook, or tine, that is cooperatively received by the mover engager (332). One with skill in the art will appreciate the numerous various configurations cooperating mover engagers (332) and rack receivers (372). Therefore, to change the interchangeable body (100) one need only disengage the coupler (600) and separate the interchangeable body (100) from the hollow shaft (200), thereby exposing the connection of the prime mover (320) to the rack (350) and allowing the disengagement of the mover engager (332) from the rack receiver (372). As one with skill in the art will recognize, attachment of a new interchangeable body (100) to the hollow shaft (200) follows the same procedure but in reverse.

Figure 13:
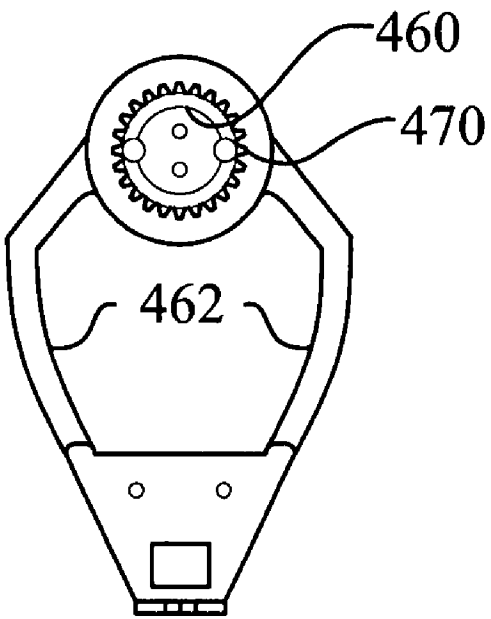
FIG. 13 is a top plan view of the pinion, not to scale.

Now focusing on the rotational motion system (450), it is attached to the rotating body portion (160) and includes a pinion (460) containing a plurality of pinion teeth (470) that cooperate with the plurality of rack teeth (380), as seen in FIG. 13. The rack (350) and pinion (460) cooperate such that the linear movement of the rack (350) from the maximum fixed backswing stop (390) to the maximum fixed follow-through stop (400) rotates the pinion (470), and thus the rotating body portion (160), through a rotational range of motion (510) from a maximum backswing position (512) to a maximum follow-through position (514), seen in FIGS. 4-7, resulting in the club (180) striking a replica golf ball (700). In operation the user grips the hollow shaft (200) and activates the translation motion system (310) by pulling the prime mover (320), and thus the rack (350), away from the interchangeable body (100) via the finger receiver (342), the rotational motion system pinion (460) cooperates with the rack (350) thereby causing the rotating body portion (160) to rotate from the maximum backswing position (512), seen in FIGS. 4 and 5, to the maximum follow-through position (514), seen in FIGS. 6 and 7, striking the replica golf ball (700) in the process.

The last main component is the coupler (600). As seen in FIG. 2, the coupler (600) releasably connects the interchangeable body mounting device (120) to the shaft proximal end (210). The coupler (600) allows a user that purchases one game system including multiple interchangeable bodies (100) to easily attach different interchangeable bodies (100) to the hollow shaft (200) thereby changing the game. The various interchangeable bodies (100) may mimic the look and swing characteristics of modern professional golfers. For instance, the swing profile, namely the backswing rotation and follow-through rotation, of a professional golfer such as Chi Chi Rodriguez is distinctly different from professional golfers such as Tiger Woods and John Daly.

The coupler (600) allows the user to quickly and easily remove one interchangeable body (100) from the reconfigurable golf fame (10) and attach a different interchangeable body (100) to entirely change the nature of the game. For instance, an interchangeable body (100) that has an extremely large rotational range of motion (510), labeled in FIG. 4, may produce greater club head speed and power than an interchangeable body (100) with a small rotational range of motion (510), but such power will likely come at the expense of reduced control of the flight of the replica golf ball (700), much like real golf.

Figure 18:
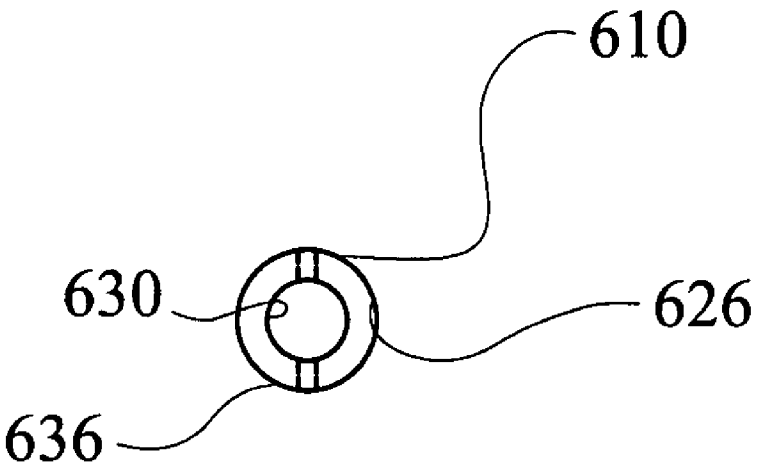
FIG. 18 is a top plan view of a distinct mechanical joining system coupler, not to scale.
Figure 17:
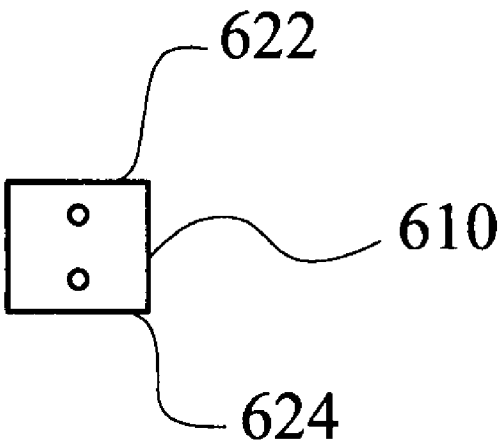
FIG. 17 is a side elevation view of a distinct mechanical joining system coupler, not to scale.
Figure 19:
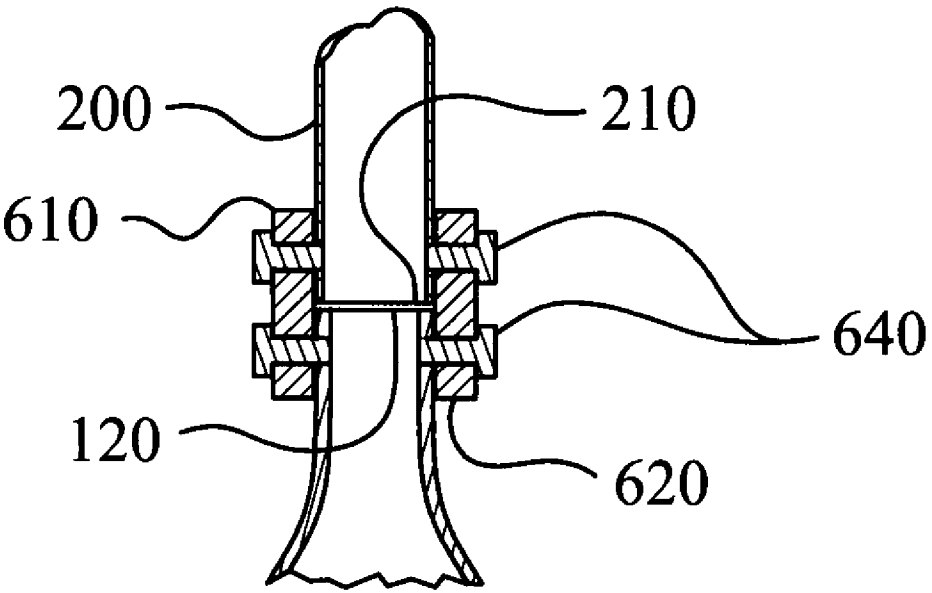
FIG. 19 is a partial cross-sectional view of a distinct mechanical joining system coupler, not to scale.

In one particular embodiment, the coupler (600) is a distinct mechanical joining system (610) rigidly attached to the body mounting device (120) and the shaft proximal end (210), as seen in FIG. 17. In this embodiment, the distinct mechanical joining system (610) includes a joining system body (620) having a first end (622) that releasably receives the shaft proximal end (210), a second end (624), that releasably receives the body mounting device (120), a perimeter (626), an interior surface (630), and an exterior surface (636), as seen in FIGS. 17-19. In this embodiment the reconfigurable golf game (10) includes at least one set-screw (640) to attach the joining system body (620) to the shaft proximal end (210) and at least one set-screw (640) to attach the joining system body (620) to the body mounting device (120). The set-screws (640) may extend into a cooperative hole in the hollow shaft (200) and the body mounting device (120), or they may simply compressively hold the components together.

Figure 20:
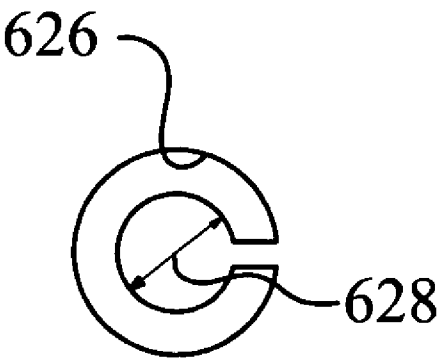
FIG. 20 is a top plan view of a distinct mechanical joining system coupler, not to scale.
Figure 21:
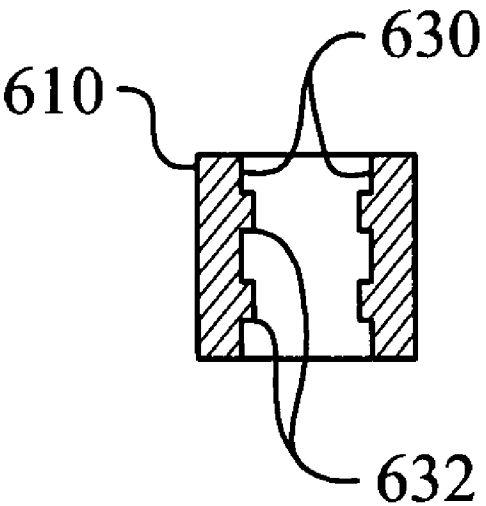
FIG. 21 is a partial cross-sectional view of an embodiment of the distinct mechanical joining system coupler, not to scale.
Figure 25:
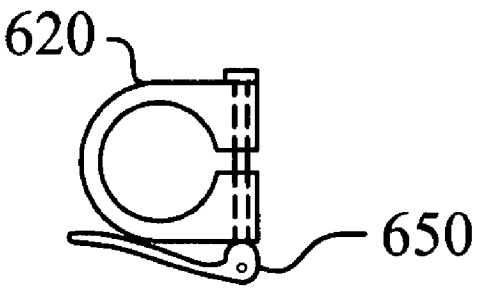
FIG. 25 is a top plan view of a distinct mechanical joining system coupler, not to scale.
Figure 24:
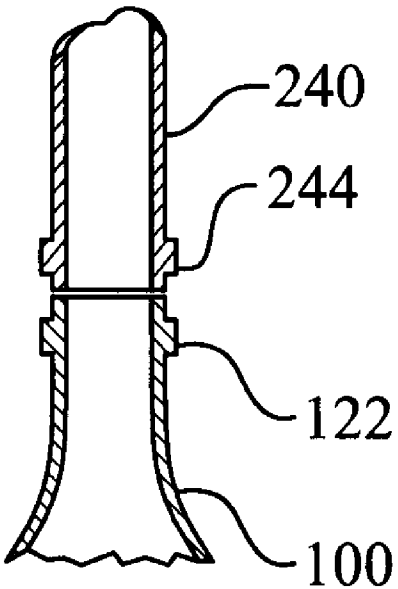
FIG. 24 is a partial cross-sectional view of a portion of the hollow shaft and a potion of the interchangeable body, not to scale.
Figure 23:
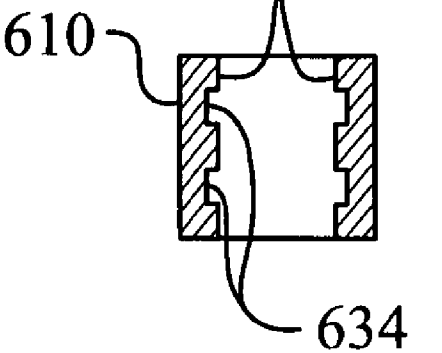
FIG. 23 is a partial cross-sectional view of an embodiment of the distinct mechanical joining system coupler, not to scale.

In an alternative embodiment seen in FIG. 20, the joining system body perimeter (626) is non-continuous thereby imparting adjustability to a joining system body diameter (628) when acted upon by a compressive force. A further variation is seen in FIGS. 21 and 22, wherein the joining system body interior surface (630) is formed to have an engagement ledge (632) projecting from the joining system body interior surface (630) that is releasably received by a shaft engagement shelf (246) formed in the shaft exterior surface (240) and is releasably received by a body engagement shelf (124) formed in the interchangeable body (100). The converse of FIGS. 21 and 22 is found in FIGS. 23 and 24 wherein the joining system body interior surface (630) has at least two engagement shelves (634) formed in the joining system body interior surface (630) wherein one engagement shelf (634) releasably receives a shaft engagement ledge (244) projecting from the shaft exterior surface (240) and one engagement shelf (634) releasably receives a body engagement ledge (122) projecting from the interchangeable body (100). Further, any of the non-continuous perimeter embodiments may further include a quick-release tensioning cam (650), as seen in FIG. 25, that cooperates with the joining system body (620) to create the compressive force resulting in the reduction and enlargement of the joining system body diameter (628), seen in FIG. 20, resulting in engagement and disengagement between the joining system body (620) and the shaft proximal end (210) and the body mounting device (120).

Figure 27:
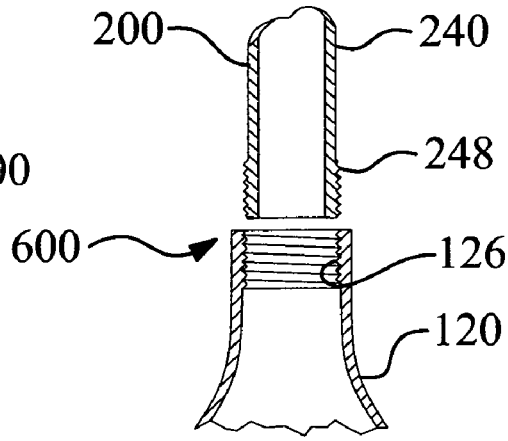
FIG. 27 is a partial cross-sectional view of a portion of the hollow shaft and a potion of the interchangeable body, not to scale.
Figure 28:
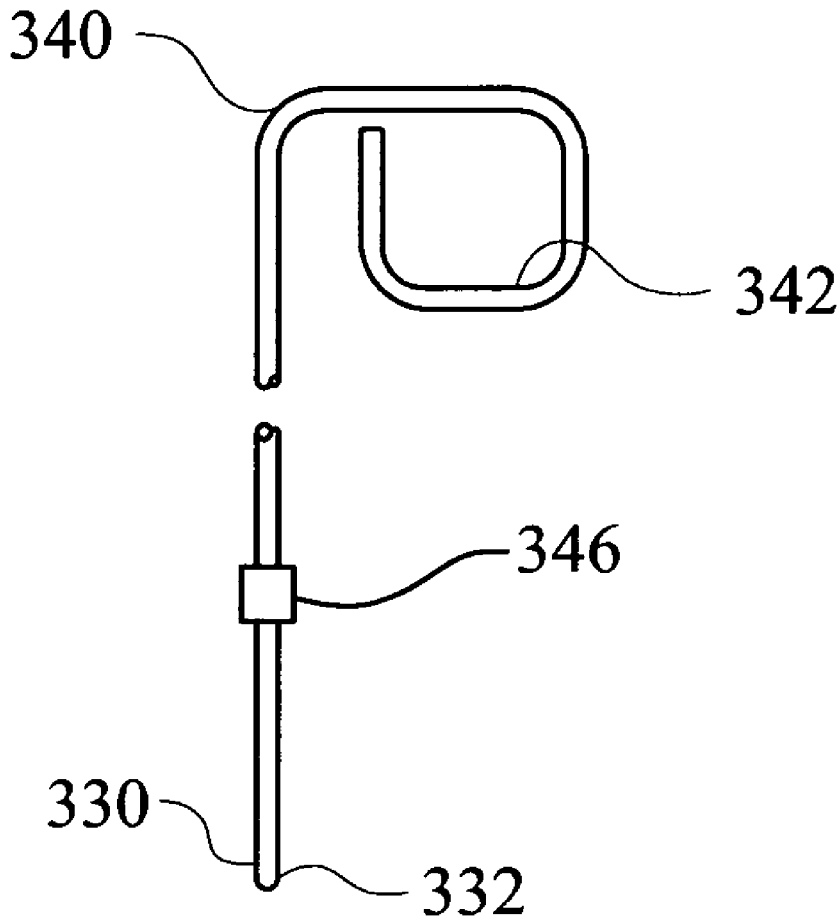
FIG. 28 is a partial front elevation view of the prime mover, not to scale.

While the coupler (600) may be a distinct mechanical joining system (610), the coupler (600) may also be integrally formed into the body mounting device (120) and the shaft proximal end (210), as seen in FIGS. 26 and 27. Such integral coupling embodiments may include variations where the hollow shaft (200) is joined to the interchangeable body (100) by snapping, twisting, and screwing. Embodiments that require rotation of the hollow shaft (200) to secure it to the interchangeable body (100) generally incorporate a mover rotational joint (346) into the prime mover (320), seen in FIG. 28, so that the rotational position of the finger receiver (342) and the mover engager (332) may remain fixed as the hollow shaft (200) is rotated. Similarly, the shaft actuation system slot (250) include a component that is substantially transverse to the linear direction of travel to accommodate rotation of the hollow shaft (200).

In one embodiment seen in FIG. 26, the coupler (600) includes a plurality of shaft interior threads (234) formed in the interior surface (230) of the shaft (200), that cooperate with a plurality of mounting device threads (126) formed in the interchangeable body mounding device (120). In an alternative embodiment seen in FIG. 27, the coupler (600) includes a plurality of shaft exterior threads (248) formed in the exterior surface (240) of the shaft (200), that cooperate with a plurality of mounting device threads (126) formed in the interchangeable body mounting device (120).

Figure 30:
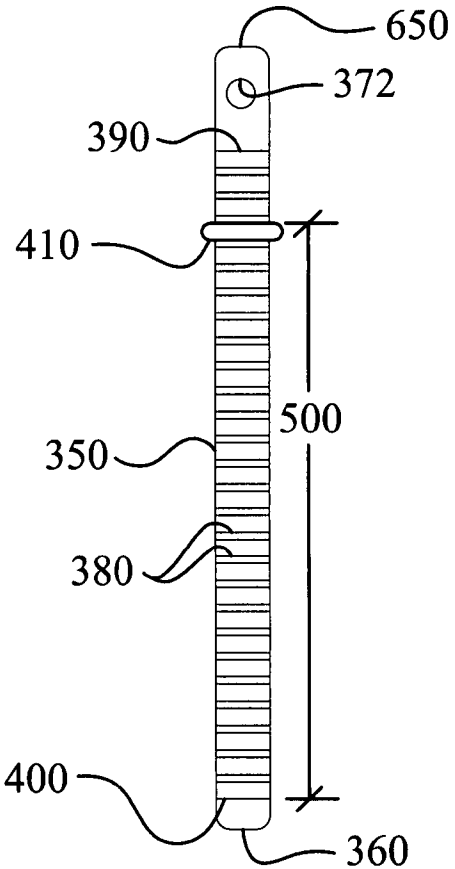
FIG. 30 is a front elevation view of the rack, not to scale.
Figure 29:
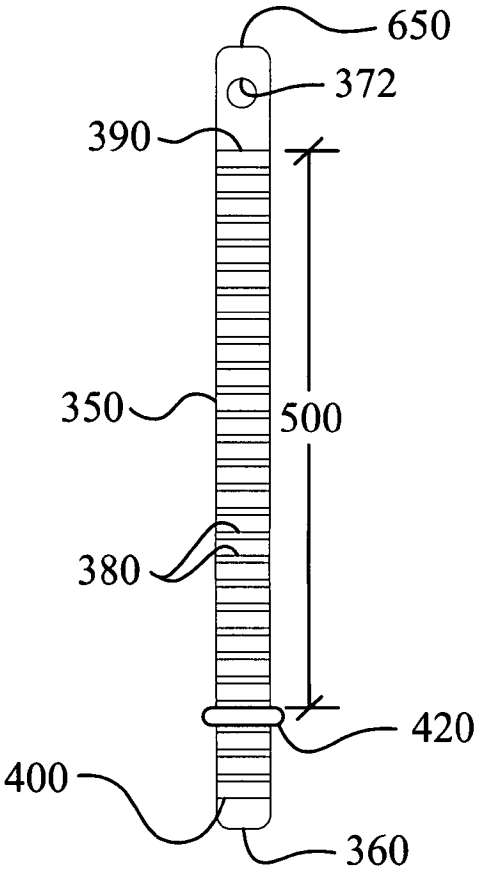
FIG. 29 is a front elevation view of the rack, not to scale.

As previously mentioned, the swing profile of the interchangeable body (100) is important to accurately mimic the swing of a particular golfer. Therefore, it is desirable to limit the extent of the backswing and the extent of the follow-through. As previously disclosed, such limitation is generally accomplished via the rack maximum fixed backswing stop (390) and the rack maximum fixed follow-through stop (400), seen in FIGS. 11 and 12. Now, from a manufacturing and financial standpoint it may be preferable to produce one standard size rack (350) and limit the rotational range of motion (510) and the linear range of motion (500) by attaching an auxiliary device to the rack (350). One embodiment includes an auxiliary rack follow-through stop (420) that releasably attaches to the rack (350) and cooperates with the rack teeth (380) to stop the interaction between the rack (350) and the pinion (460) prior to the maximum fixed follow-through stop (400) thereby selectively shortening the linear range of motion (500), as seen in FIG. 29, and the rotational range of motion (510). An alternative embodiment, seen in FIG. 30, includes an auxiliary rack backswing stop (410) that releasably attaches to the rack (350) and cooperates with the rack teeth (380) to stop the interaction between the rack (350) and the pinion (460) prior to the maximum fixed backswing stop (390) thereby selectively shortening the linear range of motion (500) and the rotational range of motion (510). Both auxiliary rack stops (410, 420) may be used on a single rack (350) to limit both the backswing and the follow-through. The auxiliary rack stops (410, 420) may simply be snap-like devices that fit between the rack teeth (380) thereby filling the space width between the faces of adjacent teeth thus blocking movement beyond that point.

Figure 31:
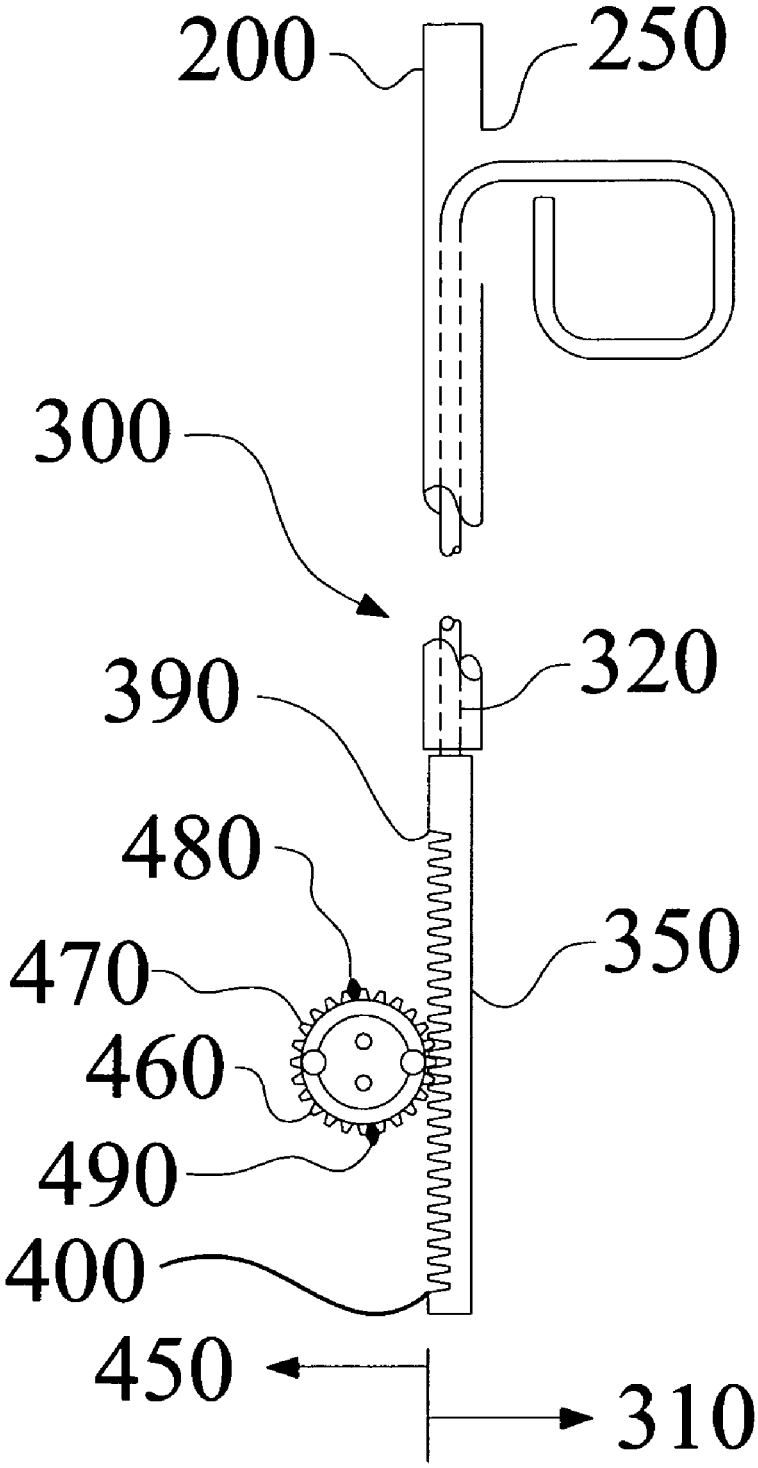
FIG. 31 is a top plan view of the pinion, not to scale.

A similar concept may be applied to the pinion (350) to limit the extent of the backswing and the extent of the follow-through. In the embodiment of FIG. 31 an auxiliary pinion backswing stop (480) has been added that releasably attaches to the pinion (460) and cooperates with the pinion teeth (470) to stop the interaction between the rack (350) and the pinion (460) prior to the maximum fixed backswing stop (390) thereby selectively shortening the linear range of motion (500) and the rotational range of motion (510). Also in the embodiment of FIG. 31, an auxiliary pinion follow-through stop (490) has been added that releasably attaches to the pinion (460) and cooperates with the pinion teeth (470) to stop the interaction between the rack (350) and the pinion (460) prior to the maximum fixed follow-through stop (400) thereby selectively shortening the linear range of motion (500) and the rotational range of motion (510). Both auxiliary pinion stops (480, 490) may be used on a single pinion (460) to limit both the backswing and the follow-through, or they may be used individually. The auxiliary pinion stops (480, 490) may simply be snap-like devices that fit between the pinion teeth (470) thereby filling the space width between the faces of adjacent teeth thus blocking movement beyond that point.

A further embodiment incorporates a helical spring (495), seen in FIG. 15, attached in-part to the non-rotating body portion (110) and attached in-part to the rotating body portion (160). The helical spring (495) is wound as the rotating body portion (160) is rotated to a backswing position, thereby developing stored potential energy that is released when the user lets go of the finger receiver (342). Upon release the wound helical spring (495) returns to the unwound position thereby releasing the potential energy and rotating the rotating body portion (160) to strike the replica golf ball (700). As one with skill in the art will appreciate, the helical spring (495) may be positioned such that the normal unwound position of the helical spring (495) returns the ball striking position or the full follow-through position. Further, one with skill in the art will appreciate that a coil spring located in the hollow shaft (200) may be utilized in lieu of the previously disclosed helical spring (495) to achieve the same effect. Such a coil spring would be connected to the translational motion system (310) and either the hollow shaft (200) or the interchangeable body (100). Movement of the translational motion system (310) would either place the coil spring in compression or tension thereby storing energy for release when the swing is initiated.

Figure 32:
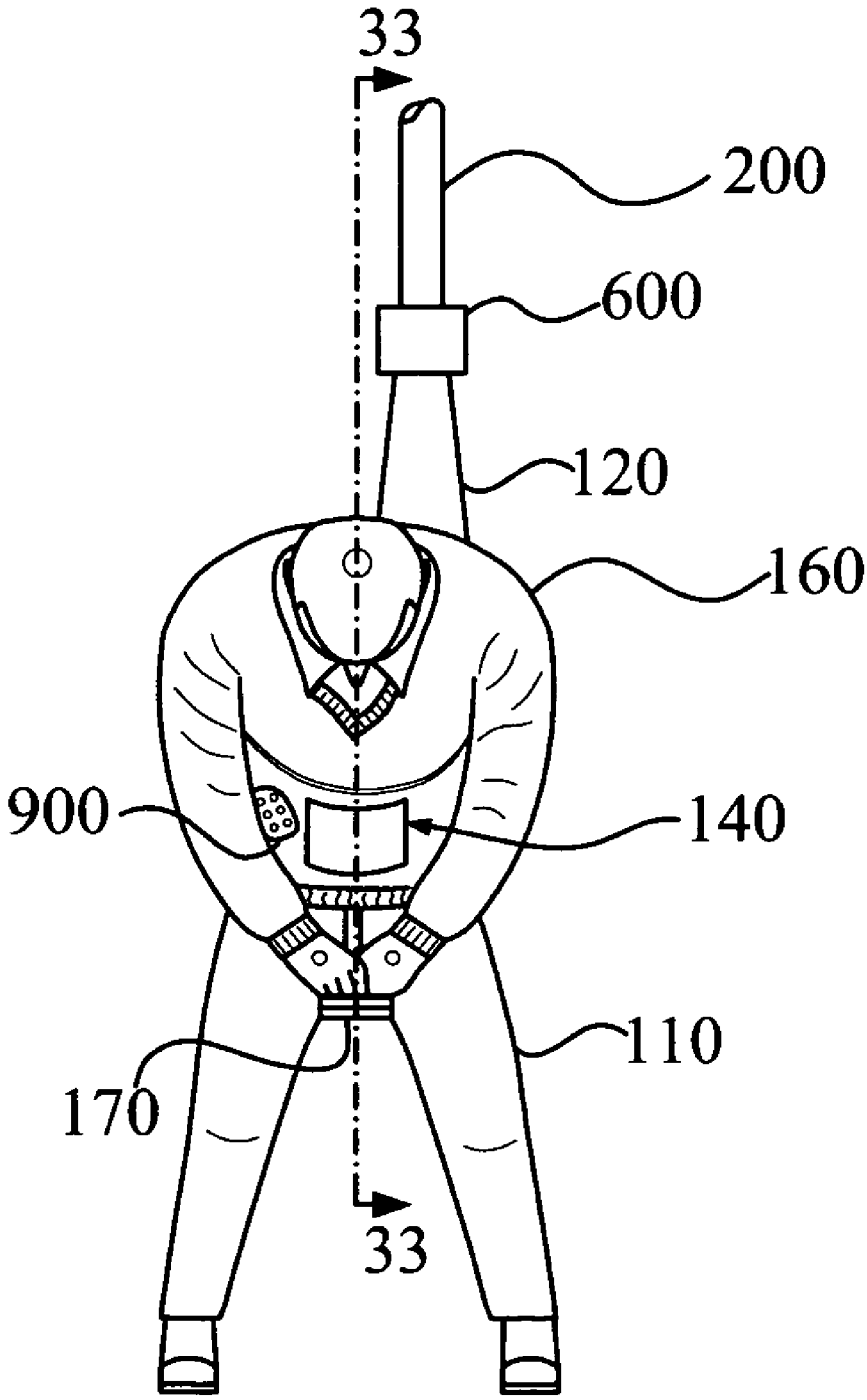
FIG. 32 is a partial front elevation of the reconfigurable golf game of the present invention, not to scale.
Figure 33:
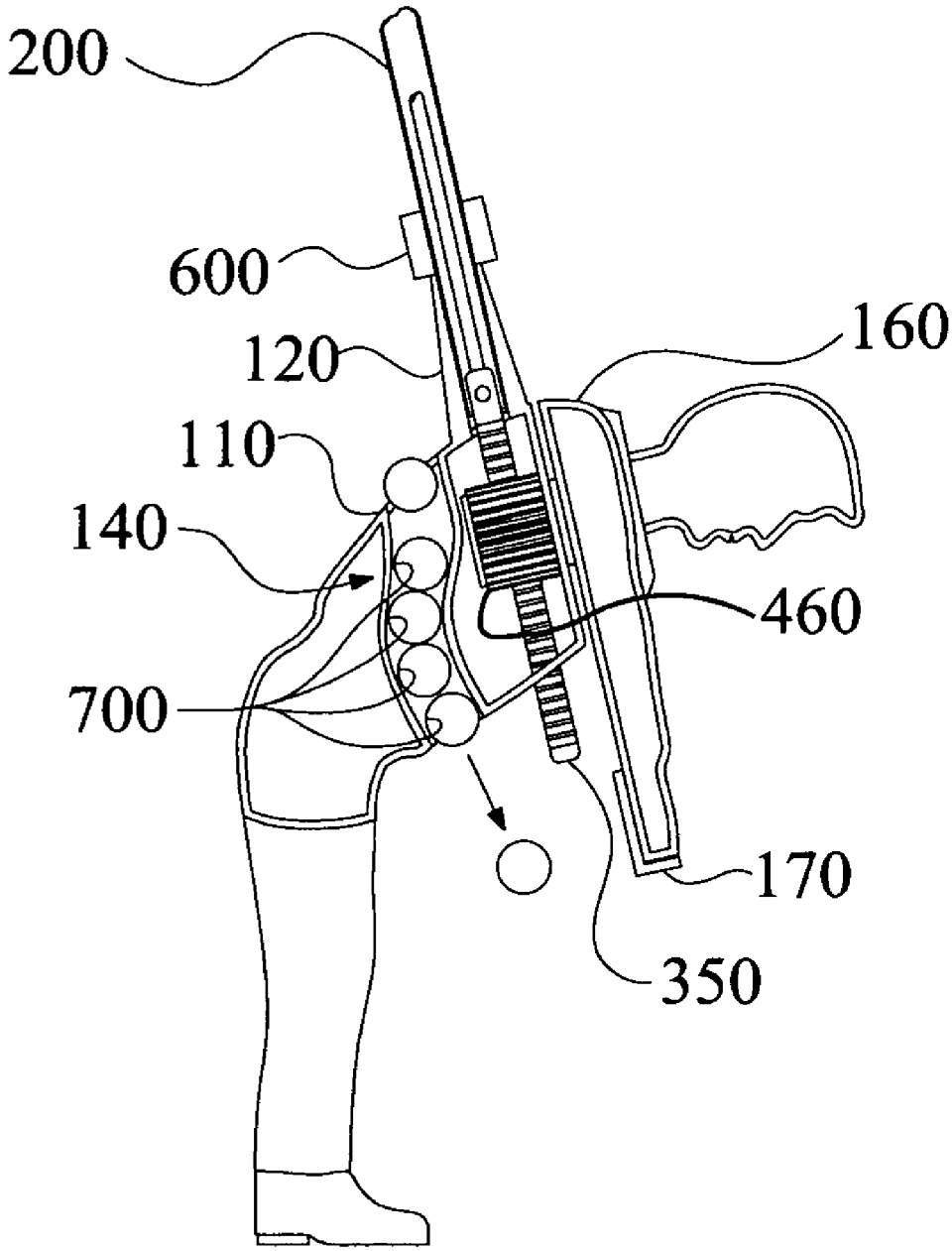
FIG. 33 is a partial side elevation of the reconfigurable golf game of the present invention, not to scale.

A further embodiment of the reconfigurable golf game (10) includes a ball storage and distribution system (140), located in the non-rotating body portion (110), that houses at least one replica golf ball (700) and discharges the at least one replica golf ball (700) upon the completion of a predetermined event, as seen in FIGS. 32 and 33. The ball storage and distribution system (140) adds the convenience of eliminating the need for the user to carry balls around with them and it eliminates the need for a user to bend over, or kneel down, to place a ball near the interchangeable body (100). In one embodiment the predetermined event that causes the discharge of the at least one replica golf ball (700) is the rotation of the rotating body portion (160) beyond a predetermined ball discharge position. Most commonly the predetermined discharge position would be the full follow-through position. In one simple embodiment the ball storage and distribution system (140) is activated by the rack (350) reaching its upward most position, as seen in FIG. 16. Release of a single replica golf ball (700) may be accomplished via the incorporation of a door, or slide gate, that is activated by the movement of the rack (350) beyond a predetermined location. Such a door, or gate, may be spring loaded to automatically shut and prevent the discharge of multiple replica golf balls (700). Alternatively, movement of the rack (350) may trigger a ball discharge mechanism that forces a single replica golf ball (700) out of the ball storage and distribution system (140). In one embodiment the ball discharge mechanism may be a rotary system including a hub containing a plurality of ball recesses that are loaded with a single replica golf ball (700) in each recess. In this embodiment, movement of the rotating body portion (160) triggers the advancement of the hub allowing a single ball to be released out of a single ball recess. An alternative embodiment may incorporate a lever-arm type of discharge mechanism that discharges a single ball upon activation.

Figure 34:
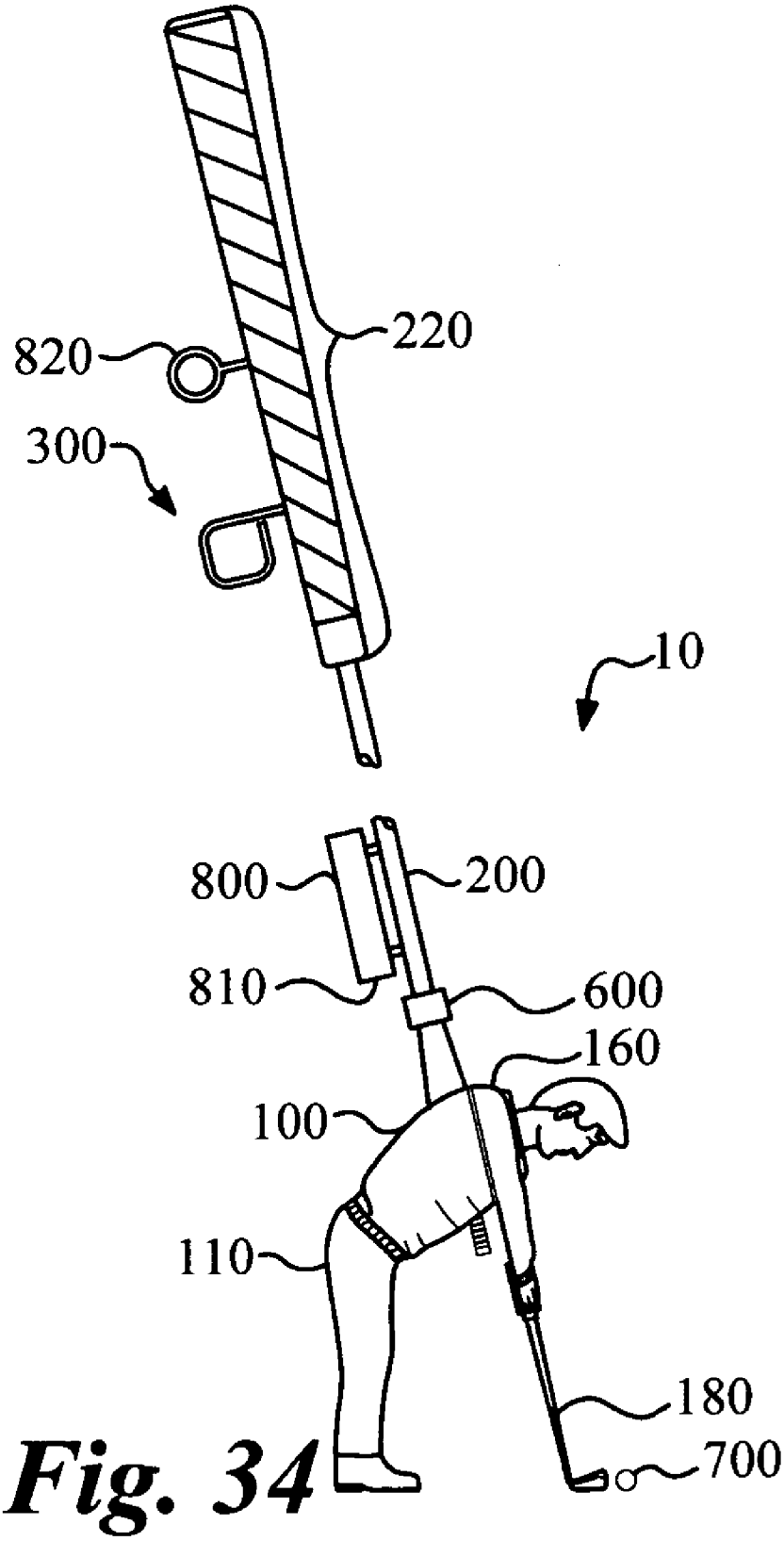
FIG. 34 is a side elevation view of the reconfigurable golf game of the present invention, not to scale.

In an alternative embodiment, the predetermined event that causes the discharge of the at least one replica golf ball (700) is the operation of a ball discharge switch (820), as seen in FIG. 34. Such a ball discharge switch (820) may be electrically or mechanically attached to the ball storage and distribution system (140) and is generally located near the shaft distal end (220). An electrical system may be a simple low-voltage DC system including a power source such as a AAA battery, a switch, and an actuator that either directly, or indirectly, releases a replica golf ball (700).

In an alternative embodiment, seen in FIG. 34, the reconfigurable golf game (10) may include an external ball storage and distribution system (800) attached to the hollow shaft (200). The external ball storage and distribution system (800) includes a ball storage canister (810) that houses at least one replica golf ball (700) and discharges the at least one replica golf ball (700) upon the completion of a predetermined event. The predetermined events that trigger the discharge of the ball, as well as the means to control or activate the discharge, may include those events and means previously discussed.

Further, as seen in FIG. 32, the reconfigurable golf game (10) may include an audible effect system (900) for producing realistic golf sound effects, which is activated by rotation of the rotating body portion (160). Such golf sound effects may include the sound of a club swinging through the air, the impact of a club and ball, grunts and groans associated with impact, the word "fore," cheering, clapping, the sound of a ball dropping into a cup, words or phrases commonly associated with a particular identifiable player, which may be in that particular player's own voice.

Figure 3:
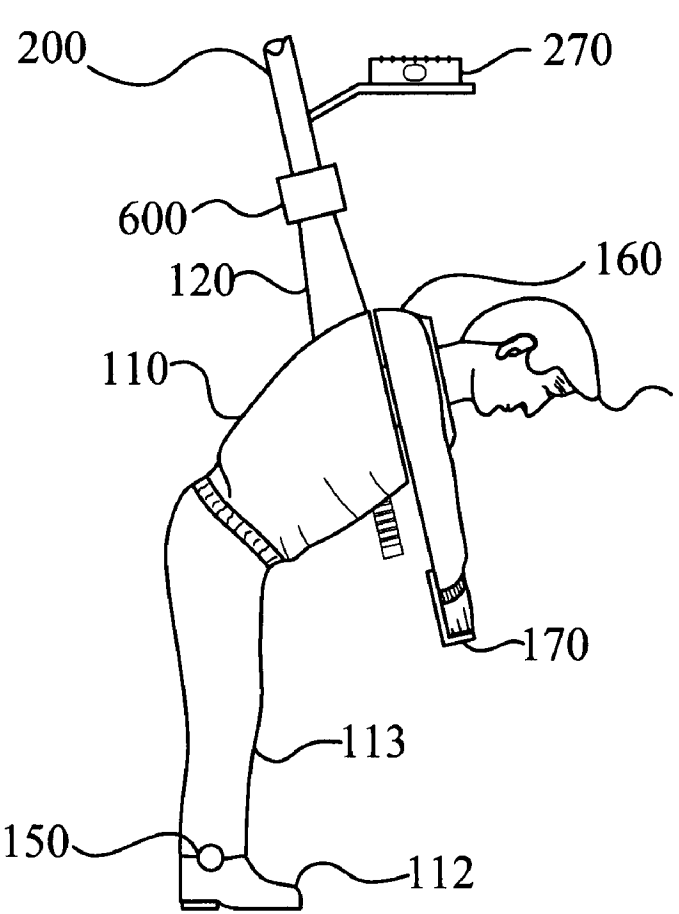
FIG. 3 is a partial side elevation of the reconfigurable golf game of the present invention, not to scale.
Figure 5:
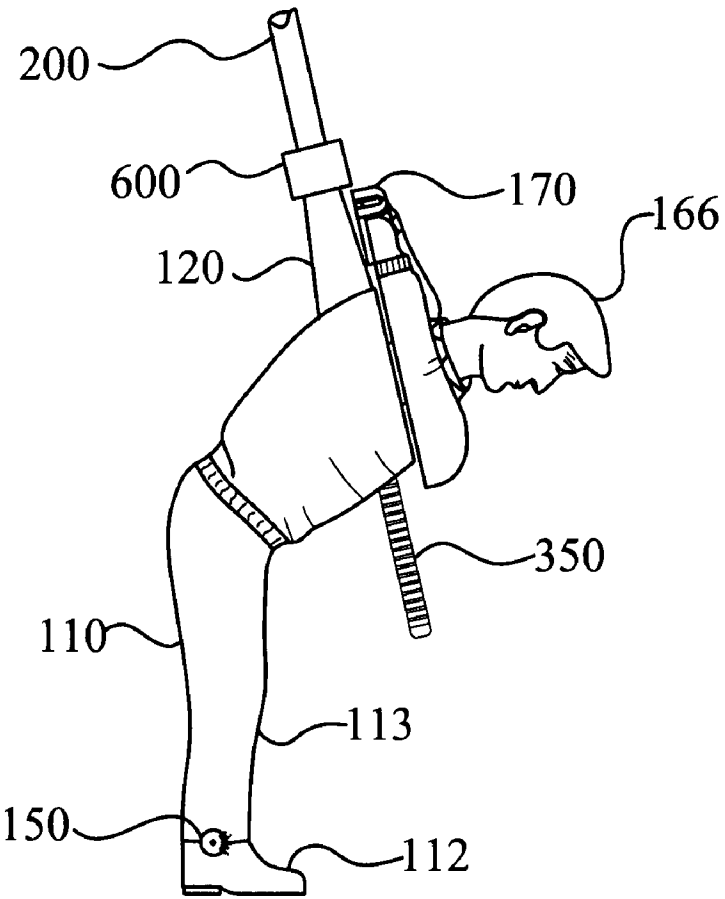
FIG. 5 is a partial side elevation of the reconfigurable golf game of the present invention in full backswing position, not to scale.
Figure 4:
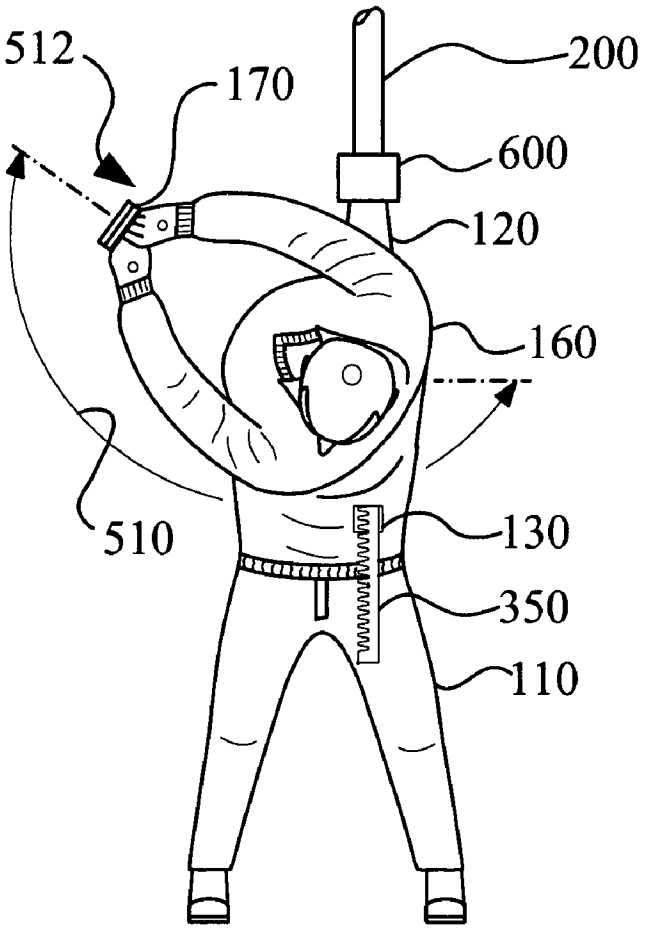
FIG. 4 is a partial front elevation of the reconfigurable golf game of the present invention in full backswing position, not to scale.
Figure 7:
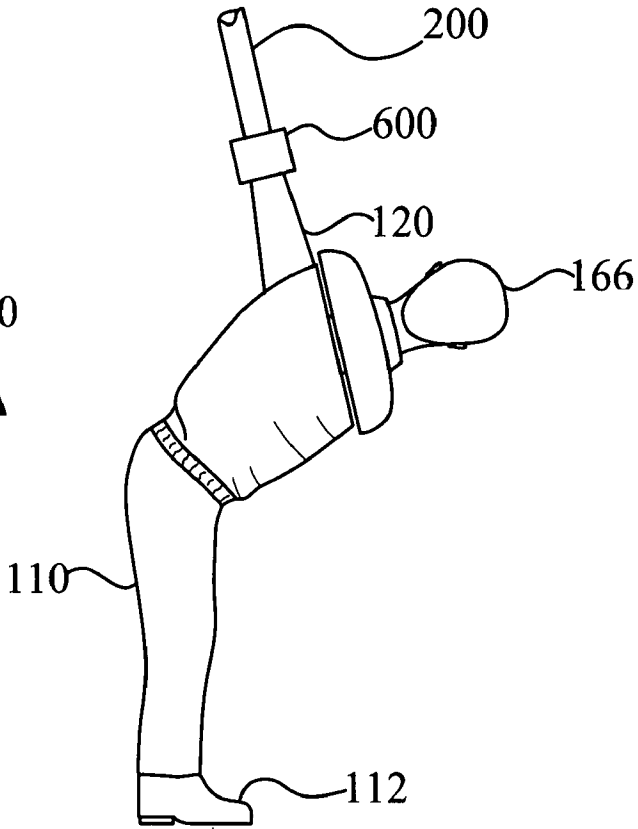
FIG. 7 is a partial side elevation of the reconfigurable golf game of the present invention in full follow-through position, not to scale.
Figure 6:
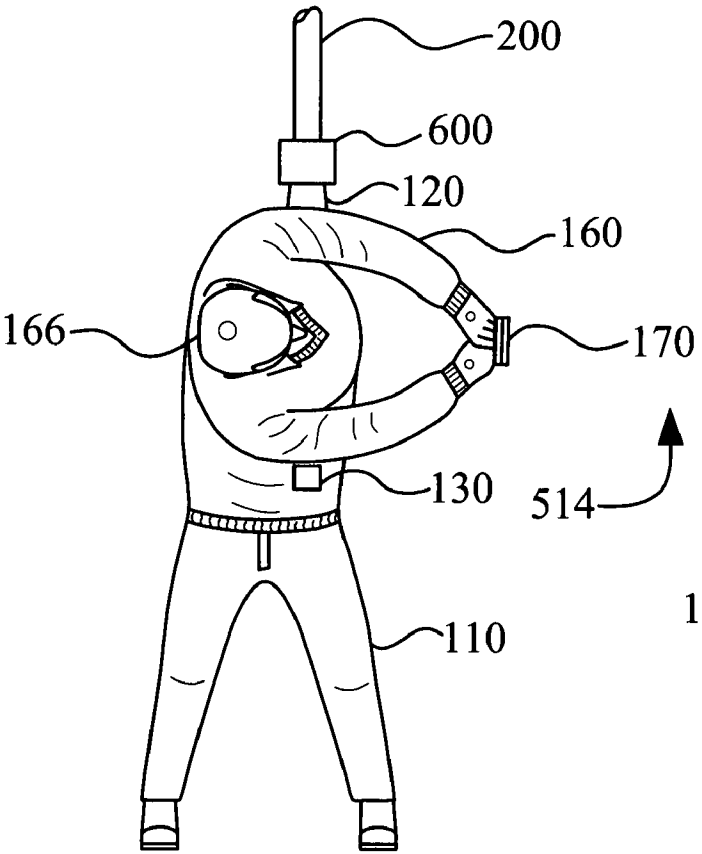
FIG. 6 is a partial front elevation of the reconfigurable golf game of the present invention in full follow-through position, not to scale.

A further embodiment of the present invention incorporates a foot hinge (150) that rotationally connects the feet (112) of the non-rotating body portion (110) to the lower leg (113), as seen in FIG. 3. The foot hinge (150) permits the user to change the angle of the hollow shaft (200) without the heel or toe of the feet (112) from leaving the ground. Additionally, the foot hinge (150) may incorporate predetermined set points that correspond to specific clubs so that matching the foot hinge (150) setting to the club (180) that is being used ensures the proper swing plane when the bottoms of the feet (112) are flat on the floor, as seen in FIG. 5. To further assist the user in obtaining the proper shaft angle a shaft angle indicator (270) may be incorporated, as seen in FIG. 3. The shaft angle indicator (270) may be a simple bubble-liquid level. It may further include indicia indicating the proper location of the bubble when utilizing a particular club. The shaft angle indicator (270) need not be a separate device attached to the hollow shaft (200) as seen in FIG. 3, but rather it may be incorporated into the interchangeable body (100) or the hollow shaft (200).

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Additionally, although the figures illustrate a right handed game and interchangeable body, one with skill in the art will recognize that this invention also includes left handed embodiments. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A reconfigurable golf game (10), comprising:

an interchangeable body (100) having a non-rotating body portion (110) and a rotating body portion (160), wherein the non-rotating body portion (110) includes a mounting device (120) and is formed with a rack passageway (130), and the rotating body portion (160) is rotably attached to the non-rotating body portion (110) and includes a club receiver (170) for releasably retaining a club (180);

a hollow shaft (200) having a shaft proximal end (210), a shaft distal end (220), an interior surface (230), and an exterior surface (240), wherein the hollow shaft (200) is formed with an actuation system slot (250) extending from the interior surface (230) to the exterior surface (240);

a swing actuation system (300) having a translational motion system (310) and a rotational motion system (450), wherein:

(A) the translational motion system (310) includes:

(i) a prime mover (320), slidably disposed within the hollow shaft (200), having a mover proximal end (330) and a mover distal end (340), wherein the mover proximal end (330) has a mover engager (332), and the mover distal end (340) has a finger receiver (342) configured to extend through the actuation system slot (250) and is shaped to receive an index finger of a human hand; and (ii) a rack (350), located in part in the rack passageway (130), having a rack proximal end (360), a rack distal end (370), and a plurality of rack teeth (380) located between the rack proximal end (360) and the rack distal end (370), wherein the rack distal end (370) has a receiver (372) designed to releasably cooperate with the mover engager (332) to transmit linear motion from the prime mover (320) to the rack (350), and wherein the rack (350) has a maximum fixed backswing stop (390) located toward the rack proximal end (360) and a maximum fixed follow-through stop (400) located toward the rack distal end (370), and the plurality of rack teeth (380) extend from the maximum fixed backswing stop (390) to the maximum fixed follow-through stop (400) defining a linear range of motion (500); and (B) the rotational motion system (450), attached to the rotating body portion (160), has a pinion (460) containing a plurality of pinion teeth (470) that cooperate with the plurality of rack teeth (380) such that the linear movement of the rack (350) from the maximum fixed backswing stop (390) to the maximum fixed follow-through stop (400) rotates the pinion (470) and the rotating body portion (160) through a rotational range of motion (510) from a maximum backswing position (512) to a maximum follow-through position (514) resulting in the club (180) striking a replica golf ball (700); and (C) an auxiliary pinion backswing stop (480) that releasable attaches to the pinion (460) and cooperates with the pinion teeth (470) to stop the interaction between the rack (350) and the pinion (460) prior to the maximum fixed backswing stop (390) thereby selectively shortening the linear range of motion (500) and the rotational range of motion (510); and a coupler (600) releasably connecting the interchangeable body mounting device (120) to the shaft proximal end (210).

2. The reconfigurable golf game (10) of claim 1, wherein the coupler (600) is a distinct mechanical joining system (610) rigidly attached to the body mounting device (120) and the shaft proximal end (210).

3. The reconfigurable golf game (10) of claim 2, wherein the distinct mechanical joining system (610) includes a joining system body (620) having a first end (622), that releasably receives the shaft proximal end (210), a second end (624), that releasably receives the body mounting device (120), a perimeter (626), an interior surface (630), and an exterior surface (636).

4. The reconfigurable golf game (10) of claim 3, further including at least one set-screw (626) to attach the joining system body (620) to the shaft proximal end (210) and at least one set-screw (640) to attach the joining system body (620) to the body mounting device (120).

5. The reconfigurable golf game (10) of claim 3, wherein the joining system body perimeter (626) is non-continuous thereby imparting adjustability to a joining system body diameter (628) when acted upon by a compressive force.

6. The reconfigurable golf game (10) of claim 5, wherein the joining system body interior surface (630) is formed to have an engagement ledge (632) projecting from the joining system body interior surface (630) that is releasably received by a shaft engagement shelf (246) formed in the shaft exterior surface (240) and is releasably received by a body engagement shelf (124) formed in the interchangeable body (100).

7. The reconfigurable golf game (10) of claim 5, wherein the joining system body interior surface (630) has at least two engagement shelves (634) formed in the joining system body interior surface (630) wherein one engagement shelf (634) releasably receives a shaft engagement ledge (244) projecting from the shaft exterior surface (240) and one engagement shelf (634) releasably receives a body engagement ledge (122) projecting from the interchangeable body (100).

8. The reconfigurable golf game (10) of claim 5, further including a quick-release tensioning cam (650) cooperating with the joining system body (620) to create the compressive force resulting in the reduction and enlargement of the joining system body diameter (628) resulting in engagement and disengagement between the joining system body (620) and the shaft proximal end (210) and the body mounting device (120).

9. The reconfigurable golf game (10) of claim 1, wherein the coupler (600) is integral to the body mounting device (120) and the shaft proximal end (210).

10. The reconfigurable golf game (10) of claim 9, wherein the prime mover (320) includes a mover rotational joint (346) dividing the prime mover (320) into two sections that may rotate independent of one another, and the coupler (600) includes a plurality of shaft interior threads (234) formed in the interior surface (230) of the shaft (200), that cooperate with a plurality of mounting device threads (126) formed in the interchangeable body mounding device (120).

11. The reconfigurable golf game (10) of claim 9, wherein the prime mover (320) includes a mover rotational joint (346) dividing the prime mover (320) into two sections that may rotate independent of one another, and the coupler (600) includes a plurality of shaft exterior threads (248) formed in the exterior surface (240) of the shaft (200), that cooperate with a plurality of mounting device threads (126) formed in the interchangeable body mounding device (120).

12. The reconfigurable golf game (10) of claim 1, further including an auxiliary rack backswing stop (410) that releasably attaches to the rack (350) and cooperates with the rack teeth (380) to stop the interaction between the rack (350) and the pinion (460) prior to the maximum fixed backswing stop (390) thereby selectively shortening the linear range of motion (500) and the rotational range of motion (510).

13. The reconfigurable golf game (10) of claim 1, further including an auxiliary rack follow-through stop (420) that releasably attaches to the rack (350) and cooperates with the rack teeth (380) to stop the interaction between the rack (350) and the pinion (460) prior to the maximum fixed follow-through stop (400) thereby selectively shortening the linear range of motion (500) and the rotational range of motion (510).

14. The reconfigurable golf game (10) of claim 1, further including an auxiliary pinion follow-through stop (490) that releasably attaches to the pinion (460) and cooperates with the pinion teeth (470) to stop the interaction between the rack (350) and the pinion (460) prior to the maximum fixed follow-through stop (400) thereby selectively shortening the linear range of motion (500) and the rotational range of motion (510).

15. The reconfigurable golf game (10) of claim 1, further including an external ball storage and distribution system (800), attached to the hollow shaft (200), including a ball storage canister (810) that houses at least one replica golf ball (700) and discharges the at least one replica golf ball (700) upon the completion of a predetermined event.

16. The reconfigurable golf game (10) of claim 1, further including an audible effect system (900) for producing realistic golf sound effects, which is activated by rotation of the rotating body portion (160).

17. The reconfigurable golf game (10) of claim 1, further including a shaft angle indicator (270) providing a visual indication of the present angle of the hollow shaft (200) and including indicia indicating the proper angle of the hollow shaft (200) for a particular club (180).

18. A reconfigurable golf game (10), comprising:

an interchangeable body (100) having a non-rotating body portion (110) and a rotating body portion (160), wherein the non-rotating body portion (110) includes a mounting device (120) and is formed with a rack passageway (130), and the rotating body portion (160) is rotably attached to the non-rotating body portion (110) and includes a club receiver (170) for releasably retaining a club (180);

a hollow shaft (200) having a shaft proximal end (210), a shaft distal end (220), an interior surface (230), and an exterior surface (240), wherein the hollow shaft (200) is formed with an actuation system slot (250) extending from the interior surface (230) to the exterior surface (240);

a swing actuation system (300) having a translational motion system (310) and a rotational motion system (450), wherein:

(A) the translational motion system (310) includes:

(i) a prime mover (320), slidably disposed within the hollow shaft (200), having a mover proximal end (330) and a mover distal end (340), wherein the mover proximal end (330) has a mover engager (332), and the mover distal end (340) has a finger receiver (342) configured to extend through the actuation system slot (250) and is shaped to receive an index finger of a human hand; and (ii) a rack (350), located in part in the rack passageway (130), having a rack proximal end (360), a rack distal end (370), and a plurality of rack teeth (380) located between the rack proximal end (360) and the rack distal end (370), wherein the rack distal end (370) has a receiver (372) designed to releasably cooperate with the mover engager (332) to transmit linear motion from the prime mover (320) to the rack (350), and wherein the rack (350) has a maximum fixed backswing stop (390) located toward the rack proximal end (360) and a maximum fixed follow-through stop (400) located toward the rack distal end (370), and the plurality of rack teeth (380) extend from the maximum fixed backswing stop (390) to the maximum fixed follow-through stop (400) defining a linear range of motion (500), wherein the rack (350) has an auxiliary rack backswing stop (410) that releasably attaches to the rack (350) and cooperates with the rack teeth (380) to stop the interaction between the rack (350) and the pinion (460) prior to the maximum fixed backswing stop (390) thereby selectively shortening the linear range of motion (500) and the rotational range of motion (510); and (B) the rotational motion system (450), attached to the rotating body portion (160), has a pinion (460) containing a plurality of pinion teeth (470) that cooperate with the plurality of rack teeth (380) such that the linear movement of the rack (350) from the maximum fixed backswing stop (390) to the maximum fixed follow-through stop (400) rotates the pinion (470) and the rotating body portion (160) through a rotational range of motion (510) from a maximum backswing position (512) to a maximum follow-through position (514) resulting in the club (180) striking a replica golf ball (700); and a coupler (600), including a distinct mechanical joining system (610), releasably and rigidly connecting the interchangeable body mounting device (120) to the shaft proximal end (210).

19. A reconfigurable golf game (10), comprising:

an interchangeable body (100) having a non-rotating body portion (110) and a rotating body portion (160), wherein the non-rotating body portion (110) includes a mounting device (120) and is formed with a rack passageway (130), and the rotating body portion (160) is ratably attached to the non-rotating body portion (110) and includes a club receiver (170) for releasably retaining a club (180), wherein the non-rotating body portion (110) includes a ball storage and distribution system (140) that houses at least one replica golf ball (700) and discharges the at least one replica golf ball (700) upon the completion of a predetermined event, and the non-rotating body portion (110) includes a foot (112) joined to a lower leg (113) by a foot hinge (150) that allows the foot (112) to rotate independently of the lower leg (113) so that the foot (112) may always remain flat on the ground;

a hollow shaft (200) having a shaft proximal end (210), a shaft distal end (220), an interior surface (230), and an exterior surface (240), wherein the hollow shaft (200) is formed with an actuation system slot (250) extending from the interior surface (230) to the exterior surface (240);

a swing actuation system (300) having a translational motion system (310) and a rotational motion system (450), wherein:

(A) the translational motion system (310) includes:

(i) a prime mover (320), slidably disposed within the hollow shaft (200), having a mover proximal end (330) and a mover distal end (340), wherein the mover proximal end (330) has a mover engager (332), and the mover distal end (340) has a finger receiver (342) configured to extend through the actuation system slot (250) and is shaped to receive an index finger of a human hand; and (ii) a rack (350), located in part in the rack passageway (130), having a rack proximal end (360), a rack distal end (370), and a plurality of rack teeth (380) located between the rack proximal end (360) and the rack distal end (370), wherein the rack distal end (370) has a receiver (372) designed to releasably cooperate with the mover engager (332) to transmit linear motion from the prime mover (320) to the rack (350), and wherein the rack (350) has a maximum fixed backswing stop (390) located toward the rack proximal end (360) and a maximum fixed follow-through stop (400) located toward the rack distal end (370), and the plurality of rack teeth (380) extend from the maximum fixed backswing stop (390) to the maximum fixed follow-through stop (400) defining a linear range of motion (500); and (B) the rotational motion system (450), attached to the rotating body portion (160), has a pinion (460) containing a plurality of pinion teeth (470) that cooperate with the plurality of rack teeth (380) such that the linear movement of the rack (350) from the maximum fixed backswing stop (390) to the maximum fixed follow-through stop (400) rotates the pinion (470) and the rotating body portion (160) through a rotational range of motion (510) from a maximum backswing position (512) to a maximum follow-through position (514) resulting in the club (180) striking a replica golf ball (700); and a coupler (600) releasably connecting the interchangeable body mounting device (120) to the shaft proximal end (210).

20. A reconfigurable golf game (10), comprising:

an interchangeable body (100) having a non-rotating body portion (110) and a rotating body portion (160), wherein the non-rotating body portion (110) includes a mounting device (120) and is formed with a rack passageway (130), and the rotating body portion (160) is rotably attached to the non-rotating body portion (110) and includes a club receiver (170) for releasably retaining a club (180), and wherein the non-rotating body portion (110) includes a ball storage and distribution system (140) that houses at least one replica golf ball (700) and discharges the at least one replica golf ball (700) upon the completion of a predetermined event;

a hollow shaft (200) having a shaft proximal end (210), a shaft distal end (220), an interior surface (230), and an exterior surface (240), wherein the hollow shaft (200) is formed with an actuation system slot (250) extending from the interior surface (230) to the exterior surface (240);

a swing actuation system (300) having a translational motion system (310) and a rotational motion system (450), wherein:

(A) the translational motion system (310) includes:

(i) a prime mover (320), slidably disposed within the hollow shaft (200), having a mover proximal end (330) and a mover distal end (340), wherein the mover proximal end (330) has a mover engager (332), and the mover distal end (340) has a finger receiver (342) configured to extend through the actuation system slot (250) and is shaped to receive an index finger of a human hand; and (ii) a rack (350), located in part in the rack passageway (130), having a rack proximal end (360), a rack distal end (370), and a plurality of rack teeth (380) located between the rack proximal end (360) and the rack distal end (370), wherein the rack distal end (370) has a receiver (372) designed to releasably cooperate with the mover engager (332) to transmit linear motion from the prime mover (320) to the rack (350), and wherein the rack (350) has a maximum fixed backswing stop (390) located toward the rack proximal end (360) and a maximum fixed follow-through stop (400) located toward the rack distal end (370), and the plurality of rack teeth (380) extend from the maximum fixed backswing stop (390) to the maximum fixed follow-through stop (400) defining a linear range of motion (500); and (B) the rotational motion system (450), attached to the rotating body portion (160), has a pinion (460) containing a plurality of pinion teeth (470) that cooperate with the plurality of rack teeth (380) such that the linear movement of the rack (350) from the maximum fixed backswing stop (390) to the maximum fixed follow-through stop (400) rotates the pinion (470) and the rotating body portion (160) through a rotational range of motion (510) from a maximum backswing position (512) to a maximum follow-through position (514) resulting in the club (180) striking a replica golf ball (700); and a coupler (600) releasably connecting the interchangeable body mounting device (120) to the shaft proximal end (210).

21. The reconfigurable golf game (10) of claim 20, wherein the predetermined event that causes the discharge of the at least one replica golf ball (700) is the rotation of the rotating body portion (160) beyond a predetermined ball discharge position.

22. The reconfigurable golf game (10) of claim 20, wherein the predetermined event that causes the discharge of the at least one replica golf ball (700) is the operation of a ball discharge switch (820).

23. A reconfigurable golf game (10), comprising:

an interchangeable body (100) having a non-rotating body portion (110) and a rotating body portion (160), wherein the non-rotating body portion (110) includes a mounting device (120) and is formed with a rack passageway (130) and includes a foot (112) joined to a lower leg (113) by a foot hinge (150) that allows the foot (112) to rotate independently of the lower leg (113) so that the foot (112) may always remain flat on the ground, and the rotating body portion (160) is rotably attached to the non-rotating body portion (110) and includes a club receiver (170) for releasably retaining a club (180);

a hollow shaft (200) having a shaft proximal end (210), a shaft distal end (220), an interior surface (230), and an exterior surface (240), wherein the hollow shaft (200) is formed with an actuation system slot (250) extending from the interior surface (230) to the exterior surface (240);

a swing actuation system (300) having a translational motion system (310) and a rotational motion system (450), wherein:

(A) the translational motion system (310) includes:

(i) a prime mover (320), slidably disposed within the hollow shaft (200), having a mover proximal end (330) and a mover distal end (340), wherein the mover proximal end (330) has a mover engager (332), and the mover distal end (340) has a finger receiver (342) configured to extend through the actuation system slot (250) and is shaped to receive an index finger of a human hand; and (ii) a rack (350), located in part in the rack passageway (130), having a rack proximal end (360), a rack distal end (370), and a plurality of rack teeth (380) located between the rack proximal end (360) and the rack distal end (370), wherein the rack distal end (370) has a receiver (372) designed to releasably cooperate with the mover engager (332) to transmit linear motion from the prime mover (320) to the rack (350), and wherein the rack (350) has a maximum fixed backswing stop (390) located toward the rack proximal end (360) and a maximum fixed follow-through stop (400) located toward the rack distal end (370), and the plurality of rack teeth (380) extend from the maximum fixed backswing stop (390) to the maximum fixed follow-through stop (400) defining a linear range of motion (500); and (B) the rotational motion system (450), attached to the rotating body portion (160), has a pinion (460) containing a plurality of pinion teeth (470) that cooperate with the plurality of rack teeth (380) such that the linear movement of the rack (350) from the maximum fixed backswing stop (390) to the maximum fixed follow-through stop (400) rotates the pinion (470) and the rotating body portion (160) through a rotational range of motion (510) from a maximum backswing position (512) to a maximum follow-through position (514) resulting in the club (180) striking a replica golf ball (700); and (C) an auxiliary pinion backswing stop (480) that releasably attaches to the pinion (460) and cooperates with the pinion teeth (470) to stop the interaction between the rack (350) and the pinion (460) prior to the maximum fixed backswing stop (390) thereby selectively shortening the linear range of motion (500) and the rotational range of motion (510); and a coupler (600) releasably connecting the interchangeable body mounting device (120) to the shaft proximal end (210).

24. The reconfigurable golf game (10) of claim 23, wherein the foot hinge (150) includes predetermined set points at which the orientation of the foot (112) and lower leg (113) are fixed to correspond to the particular club being used.

25. A reconfigurable golf game (10), comprising:

an interchangeable body (100) having a non-rotating body portion (110) and a rotating body portion (160), wherein the non-rotating body portion (110) includes a mounting device (120) and is formed with a rack passageway (130), and the rotating body portion (160) is rotably attached to the non-rotating body portion (110) and includes a club receiver (170) for releasably retaining a club (180);

a hollow shaft (200) having a shaft proximal end (210), a shaft distal end (220), an interior surface (230), and an exterior surface (240), wherein the hollow shaft (200) is formed with an actuation system slot (250) extending from the interior surface (230) to the exterior surface (240);

a swing actuation system (300) having a translational motion system (310) and a rotational motion system (450), wherein:

(A) the translational motion system (310) includes:

(i) a prime mover (320), slidably disposed within, the hollow shaft (200), having a mover proximal end (330) and a mover distal end (340), wherein the mover proximal end (330) has a mover engager (332), and the mover distal end (340) has a finger receiver (342) configured to extend through the actuation system slot (250) and is shaped to receive an index finger of a human hand; and (ii) a rack (350), located in part in the rack passageway (130), having a rack proximal end (360), a rack distal end (370), and a plurality of rack teeth (380) located between the rack proximal end (360) and the rack distal end (370), wherein the rack distal end (370) has a receiver (372) designed to releasably cooperate with the mover engager (332) to transmit linear motion from the prime mover (320) to the rack (350), and wherein the rack (350) has a maximum fixed backswing stop (390) located toward the rack proximal end (360) and a maximum fixed follow-through stop (400) located toward the rack distal end (370), and the plurality of rack teeth (380) extend from the maximum fixed backswing stop (390) to the maximum fixed follow-through stop (400) defining a linear range of motion (500); and (B) the rotational motion system (450), attached to the rotating body portion (160), has a pinion (460) containing a plurality of pinion teeth (470) that cooperate with the plurality of rack teeth (380) such that the linear movement of the rack (350) from the maximum fixed backswing stop (390) to the maximum fixed follow-through stop (400) rotates the pinion (470) and the rotating body portion (160) through a rotational range of motion (510) from a maximum backswing position (512) to a maximum follow-through position (514) resulting in the club (180) striking a replica golf ball (700);

a coupler (600) releasably connecting the interchangeable body mounting device (120) to the shaft proximal end (210); and a helical spring (495) located within the interchangeable body (100) attached in-part to the non-rotating body portion (110) and attached in-part to the rotating body portion (160) such that the helical spring (495) is wound as the rotating body portion (160) is rotated to a backswing position, thereby developing stored potential energy that is released when a user releases the finger receiver (342) thereby releasing the potential energy of the helical spring (495) and rotating the rotating body portion (160) to strike the replica golf ball (170).

* * * * *